United States Patent [19]

Haworth

[11] 4,213,493

[45] Jul. 22, 1980

[54] FABRIC RETAINER FOR PANEL

[75] Inventor: Richard G. Haworth, Holland, Mich.

[73] Assignee: Haworth Mfg., Inc., Holland, Mich.

[21] Appl. No.: 5,955

[22] Filed: Jan. 24, 1979

[51] Int. Cl.[2] ..... A47G 5/00

[52] U.S. Cl. ..... 160/351; 160/392; 160/395

[58] Field of Search ..... 160/135, 351, 392, 395, 160/394, 397; 52/222

[56] References Cited

U.S. PATENT DOCUMENTS

| | | | |
|---|---|---|---|
| 3,768,222 | 10/1973 | Birum, Jr. | 160/135 |
| 3,783,931 | 1/1974 | Assael | 160/392 |
| 3,961,661 | 6/1976 | Tombu | 160/392 |
| 4,112,643 | 9/1978 | Decker | 160/135 |

*Primary Examiner*—Peter M. Caun

*Attorney, Agent, or Firm*—Blanchard, Flynn, Thiel, Boutell & Tanis

[57] ABSTRACT

A space divider panel having fabric sheets positioned to extend across the side surfaces of the panel, with the edges of the fabric sheets being held by channel-like retainers which extend longitudinally along the panel edges. The improved retainer relies upon a spring-type clip for permitting secure holding of the fabric edge, which clip simplifies insertion of the fabric edge into the retainer while effectively providing a secure one-way holding of the edge to prevent its withdrawal. The spring clip solely holds the fabric edge, and accomplishes this without requiring the use of a deformable bead or strip.

5 Claims, 6 Drawing Figures

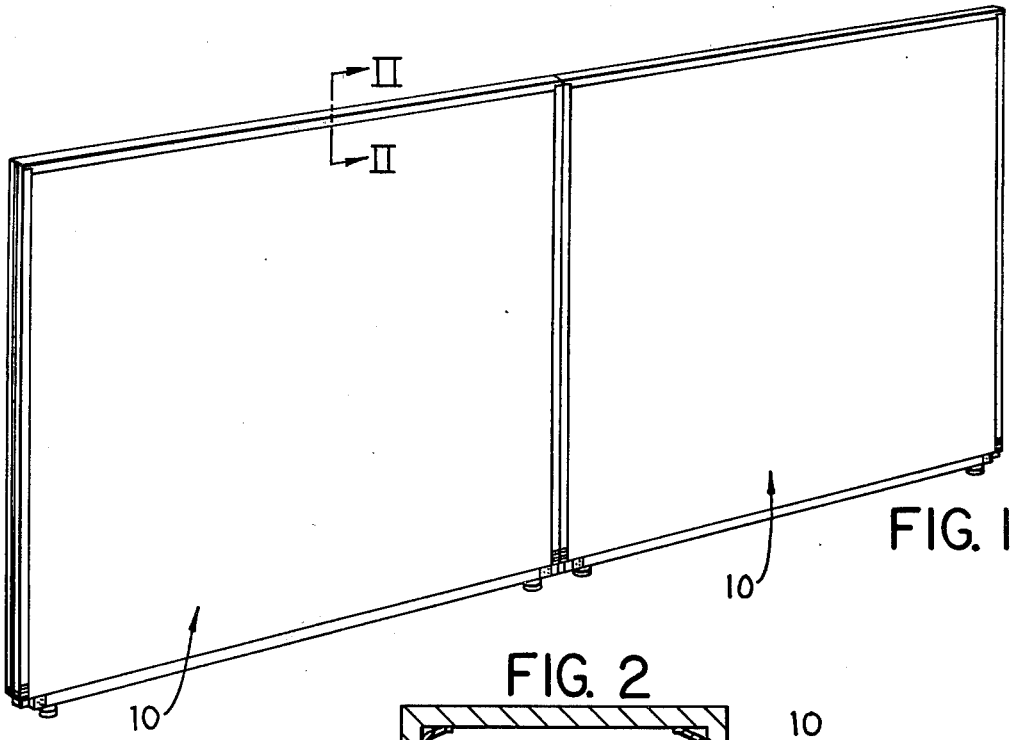
FIG. 1
FIG. 2
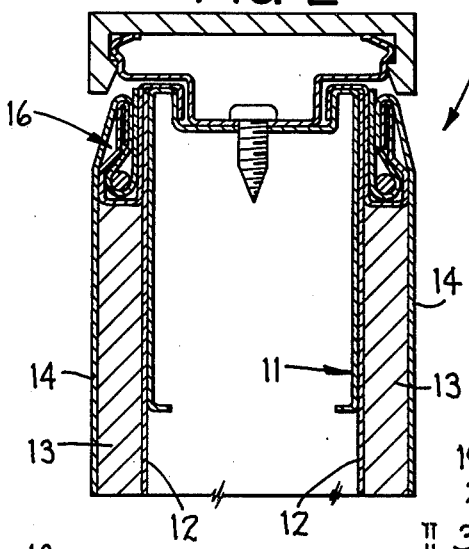
FIG. 4
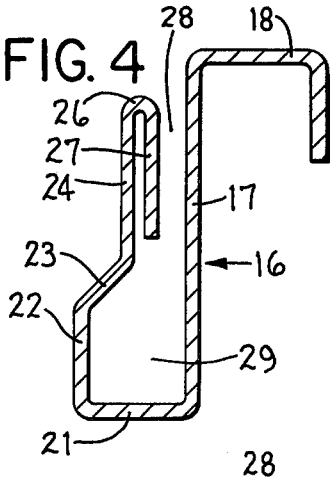
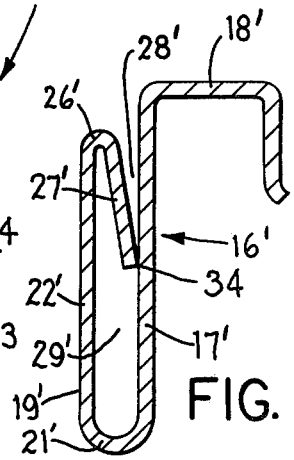
FIG. 6
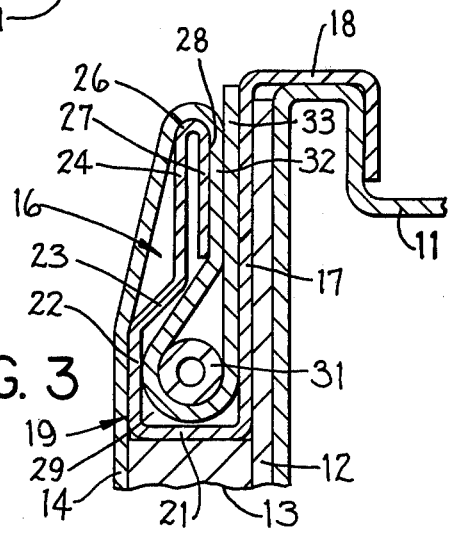
FIG. 3
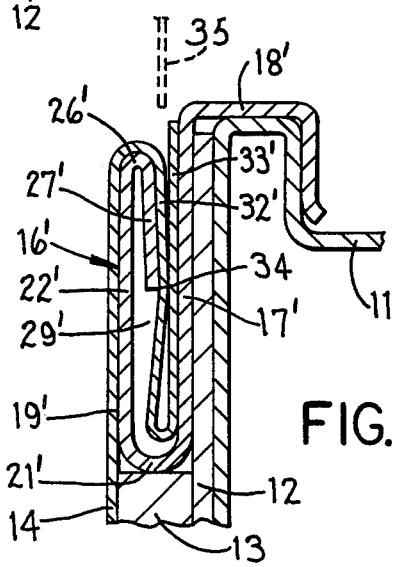
FIG. 5

FABRIC RETAINER FOR PANEL

FIELD OF THE INVENTION

This invention relates to an improved space divider panel and, in particular, to an improved retainer structure for securing a sheet of fabric over the exterior side of the panel.

BACKGROUND OF THE INVENTION

Space divider panels of the type utilized in offices and the like are often provided with sheets of flexible fabric for covering the exterior side surfaces of the panel. These fabric sheets are often provided for decorative purposes, or may be provided in superimposed relationship to an underlying fiberglass layer so that the panel will be capable of absorbing sound waves. To secure the fabric to the panel, it is conventional to staple the fabric to the underlying frame. It is also conventional to wrap the edge of the fabric around an elongated flexible element, specifically a vinyl bead, whereupon the bead and the fabric edge are then inserted into a retainer positioned along the panel edge rail. This invention is normally manually accomplished utilizing a bladelike tool, with the insertion occurring progressively along each edge of the panel until the beads and all of the fabric edges are fully inserted within the respective retainers. Needless to say, this is an inefficient and time-consuming operation in view of the substantial manual labor involved. This technique also makes it difficult to obtain proper tensioning and stretching of the fabric, and often results in undesired wrinkles along the edges or at the corners, which thereby makes the panel unacceptable, or requires that the fabric be at least partially removed and reinserted into the appropriate retainers. In addition, the necessity of having to utilize a separate bead increases the overall cost and manufacturing complexity.

Accordingly, it is an object of the present invention to provide an improved panel structure which overcomes many of the above-mentioned disadvantages and permits the manufacturing process to be carried out with significantly improved efficiency and dependability.

More specifically, it is an object of this invention to provide an improved fabric retainer for use in a space divider panel, which fabric retainer permits the secure retention of a fabric sheet in superimposed relationship over the side surface of a panel while at the same time permitting the fabric edge to be securely retained without requiring the use of a deformable bead or like element.

A further object is to provide an improved fabric retainer for a space divider panel, as aforesaid, which permits the securement of the fabric to a panel by process steps which substantially minimize or eliminate the problem of puckering or wrinking of the fabric, and which greatly minimizes the manual manipulations so that the process can be substantially automated to thereby greatly minimize the manufacturing cost of the panel.

Still a further object is to provide an improved manufacturing process for a space divider panel, which process permits the fabric to be secured to the panel in a more automated manner, thereby greatly minimizing the manual manipulation and operations involved, while at the same time improving the quality of the panels produced.

Other objects of the invention will be apparent to persons familiar with structures similar to the present invention upon reading the following specification and inspecting the accompanying drawings.

SUMMARY OF THE INVENTION

This invention relates to a space divider panel having fabric sheets positioned to extend across the side surfaces of the panel, with the edges of the fabric sheets being held by channel-like retainers which extend longitudinally along the panel edges. The improved retainer relies upon a spring-type clip for permitting secure holding of the fabric edge, which clip simplifies insertion of the fabric edge into the retainer while effectively providing a secure one-way holding of the edge to prevent its withdrawal. The spring clip solely holds the fabric edge, and accomplishes this without requiring the use of a deformable bead or strip.

BRIEF DESCRIPTION OF THE DRAWINGS

FIG. 1 is a perspective view illustrating a pair of series-connected space divider panels of conventional construction.

FIG. 2 is an enlarged, fragmentary sectional view of a panel edge, as taken substantially along line II—II in FIG. 1.

FIG. 3 is an enlarged, fragmentary sectional view illustrating a conventional structure for retaining the side fabric of a panel.

FIG. 4 is a sectional view of the conventional fabric retainer shown in FIG. 3.

FIG. 5 is a view similar to FIG. 3 but illustrating the improved structure of the present invention.

FIG. 6 is a sectional view of the improved fabric retainer shown in FIG. 3.

DETAILED DESCRIPTION

FIG. 1 illustrates a pair of substantially conventional space divider panels 10 serially connected together, with any suitable number of panels being connected as desired, so as to form a wall structure of the type used for dividing offices into smaller working regions.

The panel 10, as illustrated in FIG. 2, typically includes a rigid rectangular frame formed from elongated channel-shaped frame members 11, one such frame member extending longitudinally along each edge of the panel. The rectangular frame thus formed from the frame members 11 typically has sheetlike skins 12 fixed to and extending across and the opposite sides of the frame. These skins in turn are typically covered by a suitable layer of material 13, such as fiberglass, and these in turn are covered by decorative fabric layers 14 which extend across and define the exterior side surfaces of the panel. The four edges of fabric layer 14 are each suitably secured by a conventional retainer 16. This retainer conventionally comprises an elongated one-piece element which extends longitudinally throughout substantially the full length of each panel edge, and is formed from suitable sheetlike material, such as sheet metal.

As illustrated in FIGS. 3 and 4, the conventional retainer 16 includes a central base plate 17 which effectively overlies the side skin 12, which base plate 17 at its outer end terminates in an inwardly opening channel portion 18 which cooperates with the frame member 11 for fixing the retainer 16 thereto. The inner end of the base plate 17 terminates in a further channel portion 19 which is disposed on the opposite side from the channel portion 18, and which opens outwardly.

The channel portion 19 includes a bottom wall 21 which projects perpendicularly outwardly from the inner end of the base plate 17, and which in turn is bent at a 90° angle at its outer edge so as to integrally form an outer wall 22 which is substantially parallel with the base wall 17. Outer wall 22 in turn terminates in an intermediate wall 23 which is inclined inwardly at approximately a 45° angle, and this in turn terminates in a further outer wall 24 which is spaced inwardly from the wall 22 and is also substantially parallel with the base wall 17. The outer wall 24 terminates at a 180° bend portion 26 which, as an extension thereof, forms a further inner wall 27 which defines the free edge of the retainer. This inner wall 27, which is approximately parallel with the outer wall 24, cooperates with the base wall 17 to define an elongated narrow passage 28 therebetween. This passage 28 in turn communicates with an enlarged space or region 29 as defined at the inner end of the channel 19.

The edge of the fabric 14 is secured within the retainer 16 by means of an elongated deformable bead 31, which bead is of annular cross section and is normally constructed of an elastomeric material such as a plastic material. This bead 31 has a normal diameter substantially greater than the width of the passage 28, so that the bead 31 will substantially occupy the larger interior space 29.

During assembly, the edge of the fabric is extended across the passage 28 and the bead 31 is positioned exteriorly over the fabric. Thereafter the bead 31 and the underlying fabric is forced through the passage 28 into the interior space 29, which is accomplished by a substantial deformation and compression of the bead 31 during its passing through the passage 28, followed by a substantial expansion of the bead 31 when it enters into the enlarged region 29. This thus results in the fabric 14 being first wrapped around the curved wall portion 28 and then drawn inwardly into the passage 28 so as to be wrapped around the bead 31, with the free edge of the fabric then again passing outwardly through the passage 28. This thus results in the fabric having two superimposed layers 32 and 33 confined within the passage 28, which layers form a loop which extends around the bead 31. The expansion of the bead 31 when confined within the space 29 causes the fabric to engage with several interior walls of the channel 19 so that the fabric is hence anchored within the retainer. Because of the necessity of having to force the fabric and bead through the narrow passage 28, this operation normally is accomplished manually using a bladed tool, with the bead being progressively forced through the passage a small region at a time until the complete longitudinal length of the bead has been forced into the retainer. This operation is carried out manually and hence is inefficient and time consuming. Further, the nature of this assembly operation makes it difficult to obtain the desired tensioning of the fabric 14, and often causes puckering or wrinkling of the fabric along the edge or at the corners of the panel due to the manner in which edge is progressively inserted longitudinally along the complete length thereof.

To overcome the above disadvantages as associated with the conventional structure shown in FIGS. 2–4, the present invention relates to a panel incorporating thereon an improved fabric retainer 16', as illustrated in FIGS. 5 and 6. This retainer 16' again includes a rather large planar base plate 17' which overlies the skin 12 and, at its outer end, has a channel portion 18' for fixing the retainer to the frame member. The inner end of the base plate 17' again terminates in a channel portion 19' which opens outwardly, and the base of which is defined by an outwardly extending wall 21', same being substantially semicylindrical in the illustrated embodiment. Base wall 21' in turn terminates in an outer wall 22' which extends parallel to the base plate 17', and which at its upper end is suitably bent through an angle less than 180° to thereby form a rounded top wall 26'. This rounded top wall 26' in turn terminates in an inner wall or flange 27' which projects downwardly into the channel-like region 29' formed within the channel 19'. This flange 27' projects into the channel for only a short distance, typically less than one-half the depth of the channel, and is suitably inclined inwardly so that the lower corner or free edge 34 of the flange 27' thus typically bears against the base plate 17' when the fabric is absent from the retainer, as illustrated in FIG. 6. In a preferred embodiment, the flange 27' extends inwardly toward the base plate 17' at an angle of approximately 15°. The flange 27' effectively functions as a resiliently deflectable spring and thereby acts as a fabric holding or retaining element.

In operation, the edge of the fabric 14 is permitted to extend across the open mouth of the channel 19', and a suitable inserting element such as a flat-bladed member 35 is preferably utilized for inserting the fabric edge into the retainer 16'. As the blade 35 forces the fabric into the channel 19', which occurs by first forcing the fabric into the narrow converging passage 28', the fabric wraps around the opposite sides of the bladed element 35 and, as the bladed element is pushed deeper into the passage 28', the resilient flange or wall 27' deflects outwardly so that the bladed element and the fabric can be inserted into the retainer to substantially the full depth of the channel 19'. This insertion can be easily accomplished inasmuch as the force need be sufficient only to cause the desired resilient bending of the flange 27', which bending force is built up gradually in view of the slight slope or incline of the flange 27'. After the fabric has been fully inserted, then the bladed member 35 can be easily withdrawn inasmuch as it will readily slide outwardly from between the overlapping fabric layers 32' and 33', thereby leaving the overlapping fabric layers confined within the retainer 16' substantially as illustrated in FIG. 5. This withdrawal of the bladed element will enable the resilient flange 27' to resiliently expand, that is move back toward the base plate 17', so that the overlapping fabric layers 32' and 33' are thus tightly held between the base plate 17' and the flange 27', particularly directly adjacent the free edge 34 thereof. In view of the rather sharp corner or edge 34, the resilient flange 27' effectively functions as a one-way holding device since it permits the fabric to be rather easily inserted into the retainer, but it exerts an extremely strong holding force which effectively prevents the loosening or withdrawal of the fabric from the retainer.

In addition, the insertion force required for inserting the fabric into the retainer 16' is substantially less than that required when utilizing the retainer 16, inasmuch as the latter requires the use of a deformable bead 31. Because of this substantially reduced insertion force, the present invention is particularly desirable for permitting the complete lengthwise edge of the fabric to be simultaneously inserted into the retainer, as by utilizing an elongated inserting blade 35 having a length corresponding to the length of the retainer. This thus permits substantially the complete edge to be simultaneously inserted into the retainer, thereby avoiding the problem of wrinkling or puckering which normally occurs when the edge is progressively inserted, such as is required when utilizing a deformable bead with the conventional structure of FIGS. 3 and 4.

The use of the improved retainer 16' is particularly desirable since it permits the fabric retention operation to be substantially automated inasmuch as the fabric, when positioned over the mouth of the retainer, can be inserted solely by means of a single elongated blade extending longitudinally of the retainer. The fabric retention can thus be automatically carried out by means of one basic operation. In contrast, attempting to automate the retention technique of FIGS. 3 and 4 is further complicated not only by the higher insertion forces, but also by the use of the separate bead which must first be accurately positioned relative to the retainer and relative to the fabric, followed by the proper control over the bead and the fabric during the insertion operation.

A further advantageous result of the improved retainer 16' is that it enables the thickness of the overall panel to be reduced, which is important with some types of panels, inasmuch as the retainer 16' can be of substantially less width than the retainer 16 as is believed apparent from comparing FIGS. 3 and 5. The retainer 16' also can be formed more efficiently than the retainer 16 inasmuch as substantially fewer forming or bending operations are required.

In an advantageous variation of the invention, the free edge 34 of retainer 16' may be formed as a serrated edge (when viewed in the longitudinal direction of the retainer) so as to permit a positive gripping of the fabric.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a substantially rectangular space divider panel having a frame member extending longitudinally along each edge thereof, a channel-like fabric retainer fixedly positioned adjacent each exterior side of each said frame member and extending longitudinally thereof, and a thin sheet of flexible fabric extending tautly across each of the exterior side surfaces of said panel, said fabric sheets having the edge portions thereof fixedly secured within the respective retainers, comprising the improvement wherein said retainer includes a channel portion positioned adjacent said frame member and opening outwardly toward the edge of said panel, said channel portion including inner and outer substantially parallel walls joined together by a bottom wall and defining an outwardly opening channel, said outer wall at its free end terminating in a rounded wall which projects inwardly and which terminates in an inner flange projecting inwardly into the channel, said inner flange being disposed between said inner and outer walls and extending at a slight incline relative to said inner and outer walls so that the free edge of said flange is disposed closely adjacent said inner wall, the free edge of said flange being spaced a substantial distance from said bottom wall, said fabric sheet extending across said outer wall and wrapping around said rounded wall, said fabric sheet having an edge portion positionedwithin said channel, the edge portion of said fabric sheet including overlying layers which define a fold positioned within said channel in the vicinity of said bottom wall, said overlying layers causing said flange to be resiliently deflected so that said overlying layers are resiliently held between the free edge of said flange and the opposed inner wall.

2. A panel according to claim 1, wherein the edge portion of the fabric sheet is held solely by the resilient gripping thereof between the inner wall and the free edge of said flange, the securement of said fabric sheet within said retainer being accomplished without the use of a deformable bead or the like.

3. A panel according to claim 2, wherein said flange extends at an angle of approximately 15° relative to said inner wall.

4. A panel according to any one of claims 1–3, wherein the free edge of said flange is normally in engagement with said inner wall prior to insertion of said fabric into said channel.

5. A panel according to any one of claims 1–3, wherein said inner and outer walls are each substantially planar and are substantially uniformly spaced apart.

* * * * *